US005944585A

United States Patent [19]

Nagahara et al.

[11] Patent Number: 5,944,585

[45] Date of Patent: Aug. 31, 1999

[54] USE OF ABRASIVE TAPE CONVEYING ASSEMBLIES FOR CONDITIONING POLISHING PADS

[75] Inventors: Ronald J. Nagahara, San Jose; Dawn M. Lee, Morgan Hill, both of Calif.

[73] Assignee: LSI Logic Corporation, Milpitas, Calif.

[21] Appl. No.: 08/942,991

[22] Filed: Oct. 2, 1997

[51] Int. Cl.[6] ..... B24B 1/00

[52] U.S. Cl. ..... 451/56; 451/72; 451/304; 451/305; 451/306; 451/443

[58] Field of Search ..... 451/56, 72, 304, 451/305, 306, 443

[56] References Cited

U.S. PATENT DOCUMENTS

| | | | |
|---|---|---|---|
| 3,744,188 | 7/1973 | Sharpless | 451/350 |
| 4,347,689 | 9/1982 | Hammond | 451/163 |
| 4,671,018 | 6/1987 | Ekhoff | 451/308 |
| 5,081,051 | 1/1992 | Mattingly et al. . | |
| 5,216,843 | 6/1993 | Breivogel et al. . | |
| 5,536,202 | 7/1996 | Appel et al. . | |
| 5,547,417 | 8/1996 | Breivogel et al. . | |
| 5,643,044 | 7/1997 | Lund | 451/5 |

*Primary Examiner*—David A. Scherbel
*Assistant Examiner*—Shantese McDonald
*Attorney, Agent, or Firm*—Beyer & Weaver, LLP

[57] ABSTRACT

A conveying assembly in a conditioning sub-assembly for conveying a conditioning surface to a polishing pad during conditioning is described. The conveying assembly includes an arm and a guiding component connected to the arm and adapted to guide the conditioning surface about the conveying assembly, thereby allowing another area of the conditioning surface to advance and become available for conditioning.

24 Claims, 6 Drawing Sheets

USE OF ABRASIVE TAPE CONVEYING ASSEMBLIES FOR CONDITIONING POLISHING PADS

BACKGROUND OF THE INVENTION

The present invention relates to conditioning of a polishing pad employed in chemical-mechanical polishing (sometimes referred to as "CMP"). More particularly, the present invention relates to conditioning sub-assemblies including conveying assemblies that employ either continuous feed or closed loop abrasive tape for effective conditioning of a polishing pad.

Chemical mechanical polishing (CMP) typically involves mounting a wafer faced down on a holder and rotating the wafer face against a polishing pad mounted on a platen, which in turn is rotating or is in an orbital state. A slurry containing a chemical that chemically interacts with the facing wafer layer and an abrasive that physically removes that layer is flowed between the wafer and the polishing pad or on the pad near the wafer. In semiconductor wafer fabrication, this technique is commonly applied to polish various wafer layers such as dielectric layers, metallization, etc.

Unfortunately after polishing on the same polishing pad for over a period of time, the polishing pad suffers from "pad glazing." As is well known in the art, pad glazing results when the particles eroded from the wafer surface along with the abrasives in the slurry tend to glaze or accumulate over the polishing pad. A glazed layer on the polished pad typically forms from eroded film and slurry particles that are embedded in the porosity or fibers of the polishing pad. Pad glazing is particularly pronounced during planarization of an oxide layer such as silicon dioxide layer (hereinafter referred to as "oxide CMP"). By way of example, during oxide CMP, eroded silicon dioxide particulate residue accumulates along with the abrasive particles from the slurry to form a glaze on the polishing pad. Pad glazing is undesirable because it reduces the polishing rate of the wafer surface and produces a non-uniformly polished wafer surface. The non-uniformity results because glazed layers are often unevenly distributed over a polishing pad surface.

One way of achieving and maintaining a high and stable polishing rate is by conditioning the polishing pad (hereinafter referred to as "pad conditioning") on a regular basis, i.e. either every time after a wafer has been polished or simultaneously during wafer CMP. FIG. 1 shows a side-sectional view of a cross-section of a polishing pad 102 undergoing conditioning according to current techniques of pad conditioning carried out in conventional or modern CMP systems. A surface of polishing pad 102 that is employed for oxide CMP has deposited on it a glazed oxide layer 104 resulting from pad glazing described above. During pad conditioning, a stream of water 106 is introduced over the polishing pad and a particle 108, for example, is dislodged from glazed layer 104 by mechanical action of a conditioning disk or arm (not shown to simplify illustration), described below in detail, to produce dislodged particles 108'. Furthermore, loose oxide particles 110 may also be found on the surface of polishing pad 104 as eroded oxide or slurry residue from CMP.

FIG. 2 shows some significant components of a conditioning sub-assembly 150 employed in conventional CMP systems. Conditioning sub-assembly 150 includes a conditioning arm 156 that is connected to a pneumatic cylinder (not shown to simplify illustration) on one end and on the other end has a connection 158, which connects to an end effector holder 160. An end effector 162 is secured at the top by end effector holder 160 and has mounted below it a conditioning disk 164 having abrasive particles 166.

During a typical conditioning cycle in the conventional CMP systems, a conditioning reagent is dispensed on polishing pad 152 through a separate outlet (not shown to simplify illustration) and conditioning disk 164 is lowered automatically to contact polishing pad 152, which may be rotating. The pneumatic cylinder then applies a downward force on conditioning disk 164 such that abrasive particles 166 engage polishing pad 152 as the conditioning disk along with end effector 162 moves on the polishing pad surface.

By way of example, in a conventional CMP system such as the Avanti 472, commercially available from Integrated Processing Equipment Corporation (IPEC) of Phoenix, Ariz., an oscillating motor (not shown to simplify illustration) coupled to connection 158 allows conditioning disk 164 to slide along a length of a stationary conditioning arm 156 in a radial direction from typically center to the edge of polishing pad 152. As another example, in the conventional CMP assembly of Strasbaugh 6DS-JP, commercially available from Strasbaugh of San Luis Obispo, Calif., conditioning disk 164 and end effector 162 are secured on conditioning arm 156, which moves in a radial direction of the polishing pad typically from center to the edge of polishing pad 152. The mechanical action of the conditioning disk in both examples attempts to break up and remove the glazed or accumulated particles coated on the polishing pad surface.

FIG. 3A shows some significant components of a conditioning sub-assembly 200, which is integrated into a modern CMP system, such as the AvantGaard 676, also commercially available from Integrated Processing Equipment Corporation (IPEC) of Phoenix, Ariz. Conditioning sub-assembly 200 includes a conditioning arm 204 that is disposed above a polishing pad 202 and capable of pivoting about a pivoting point 206. Conditioning arm 204, as shown in FIG. 3A, is typically longer in length than the diameter of polishing pad 202.

FIG. 3B shows a bottom view of conditioning arm 204 of FIG. 3A. The bottom surface of conditioning arm 204 includes a plurality of diamond abrasive particles 208, which are almost uniformly arranged on conditioning 204 arm such that if the conditioning arm contacts polishing pad 202, abrasive particles 208 engage a portion of the polishing pad. A manifold 210 having a plurality of openings 212 is mounted on both sides of conditioning arm 204, as shown in FIG. 3B. Openings 212 are designed to dispense a conditioning reagent on polishing pad 202 during pad conditioning and are therefore in communication with a reservoir of conditioning reagent (not shown to simplify illustration). In this configuration, openings 212 along with manifold 210 span the entire length of conditioning arm 204.

During a typical conditioning cycle in the modern CMP systems, a conditioning reagent is introduced on polishing pad 202 of FIG. 3A through openings 212 of FIG. 3B and conditioning arm 204 is lowered automatically to contact polishing pad 202, which may be in orbital motion. A pneumatic cylinder then applies a downward force on conditioning arm 204 such that abrasive particles 208 of FIG. 3B engage polishing pad 202 of FIG. 3A. Conditioning arm 204 typically sweeps back and forth across polishing pad 202 like a "windshield wiper blade" from one end (shown by conditioning arm 204') of the polishing pad to another (shown by conditioning arm 204") as shown in FIG. 3A to remove the glazed or accumulated particles coated on the polishing pad surface.

Unfortunately, pad conditioning carried out in conventional and modern CMP systems suffer from several drawbacks. By way of example, after repeated conditioning by the same conditioning or abrasive surface for a certain period of time in both the conventional and modern CMP systems, abrasive particles may dislodge from the conditioning disk surface or conditioning arm surface due to normal surface wear. The dislodged abrasive particles may remain on the polishing pad surface and scratch wafer surfaces that are subsequently polished on the polishing pad. This lowers the yield of the CMP process.

As another example, in the conventional CMP systems, in order to avoid scratching of the wafer surface, the conditioning disk may undergo a "wear-in" process before pad conditioning is carried out to make sure that all loosely secured abrasive particles are removed from the conditioning disk surface. This lowers the throughput of the wafer CMP process. Furthermore, when the abrasive particles are worn out, the conditioning disk must be replaced. In a typical semiconductor fabrication facility, for example, where several CMP systems are in operation, replacement costs for conditioning disks can be significant. Further still, determining whether a conditioning disk surface is worn out requires closely monitoring the changes on the wafer surfaces, which undergo polishing on the conditioned polishing pad.

As yet another example, in the modern CMP systems, typically the abrasive particles are secured on an adhesive tape that adheres to the conditioning arm. After the same abrasive tape is used for pad conditioning over a period of time, the abrasive tape often begins to peel off the conditioning arm and the pad conditioning process is not as effective, leading to poor and non-uniform film removal rates.

What is therefore needed is an improved pad conditioning sub-assembly that may be integrated into conventional and modern CMP systems.

SUMMARY OF THE INVENTION

To achieve the foregoing, the present invention provides a conveying assembly in a conditioning sub-assembly for conveying a conditioning surface to a polishing pad during conditioning. The conveying assembly includes an arm and a guiding component connected to the arm and adapted to guide the conditioning surface about the conveying assembly, thereby allowing another area of the conditioning surface to advance and become available for conditioning.

A conditioning sub-assembly of the present invention for conditioning a polishing pad may include the above described conveying assembly, a supply reel for supplying a conditioning tape having a conditioning surface on the conveying assembly and a take-up reel adapted to collect the conditioning tape off the conveying assembly and supplied by the supply reel.

The conditioning assembly may further include a conditioning tape including a conditioning surface having abrasive particles disposed thereon. The guiding component may include a tension roller designed to maintain the conditioning tape under sufficient tension for effective conditioning of the polishing pad. Pin connections in the tension roller may facilitate the connection between the arm and the tension roller.

The arm may be a first arm and the conditioning sub-assembly may further include a second arm separated from the first arm, a front bridging component connecting the first arm and the second arm at a front end of the conveying assembly, and a rear bridging component connecting the first arm and the second arm at a rear end of the conveying assembly, the rear end is positioned further away from the polishing pad than the front end during conditioning, wherein the conveying assembly is adapted to receive a conditioning tape having a conditioning surface such that during conditioning the conditioning tape is disposed above and reels around underneath the front bridging component.

The conditioning assembly of the present invention may further include a pivoting arm connected to a rear connection component that functions as a pivoting connection, about which the pivoting arm and the conveying assembly can pivot. The pivoting arm in a first position enables the conveying assembly to be placed at an angle with respect to the polishing pad and allows at least a portion of the conditioning tape underneath the guiding component to contact the polishing pad during conditioning of the polishing pad. In a second position, the pivoting arm enables the conveying assembly to be placed almost parallel to the polishing pad and allows at least a portion of the conditioning tape underneath the conveying assembly to contact the polishing pad during conditioning of the polishing pad.

The pivoting arm may be connected to a pneumatic cylinder that applies a downward force during conditioning of the polishing pad. The pivoting arm may be in communication with an actuator that allows the conditioning sub-assembly to oscillate in a radial direction on the polishing pad during conditioning of the polishing pad.

In another embodiment, the conveying assembly of the present invention may further include a rear connection component and the conditioning tape is disposed above and reels around underneath the rear connection component to form a closed loop of conditioning tape around the conveying assembly. The rear connection component may include a roller. A conditioning sub-assembly, according to the present invention, may incorporate this conveying assembly and include a pivoting arm connected to the rear connection component that functions as a pivoting connection, about which the pivoting arm and the conveying assembly can pivot.

In a first position, the pivoting arm enables the conveying assembly to be placed at an angle with respect to the polishing pad and allows at least a portion of the conditioning tape underneath the guiding component to contact the polishing pad during conditioning of the polishing pad. In a second position, the pivoting arm enables the conveying assembly to be placed almost parallel to the polishing pad and allows at least a portion of the conditioning tape underneath the conveying assembly to contact the polishing pad during conditioning of the polishing pad.

In another aspect, the present invention provides a conveying mechanism in a conditioning sub-assembly for conveying means for conditioning to a polishing pad during conditioning. The conveying mechanism includes means for supporting and means for guiding connected to the means for supporting and adapted to guide the means for conditioning about the conveying assembly, thereby allowing another area of the means for conditioning to advance and become available for conditioning.

The means for guiding may include a tension roller designed to maintain the means for conditioning under tension during conditioning and the means for conditioning includes a conditioning tape.

In yet another aspect, the present invention provides a process for conditioning a polishing pad. The process includes providing a conditioning sub-assembly including a conveying assembly for conveying a conditioning surface to a polishing pad during conditioning, introducing a conditioning reagent on the polishing pad, mounting a conditioning tape having a conditioning surface on the conveying assembly, lowering the conveying assembly so that the conditioning surface of the conditioning tape contacts the polishing pad, oscillating the conveying assembly on the polishing pad and applying a downward force on the conveying assembly such that the conditioning surface of the conditioning tape engages and thereby effectively conditions the polishing pad. The conveying assembly employed in the process includes an arm, a guiding component connected to the arm and adapted to guide the conditioning surface about the conveying assembly, thereby allowing another area of the conditioning surface to advance and become available for conditioning, a rear connection component connected to the arm at a rear end of the conveying assembly and the rear connection component is located further away from the polishing pad the guiding component during conditioning of the polishing pad and a pivoting arm capable of pivoting and connected to the rear connection component, about which the conveying assembly and the pivoting arm can pivot.

The step of mounting the conditioning tape may include a step of providing a supply reel that holds a feed roll of conditioning tape and a take-up reel that collects the conditioning tape provided by the supply reel and a step of supplying the conditioning tape on the conveying assembly such that the conditioning tape is disposed above and reels around underneath the guiding component.

After the applying a downward force, the process may further include a step of feeding a predetermined amount of the conditioning tape on the conveying assembly and a step of conditioning the polishing pad by at least a portion of the predetermined amount of the conditioning tape.

The step of mounting the conditioning tape may include supplying the conditioning tape on the conveying assembly such that the conditioning tape is disposed above and reels around underneath the guiding component and the conditioning tape is disposed above and reels around underneath the rear connection component to form a closed loop of conditioning tape around the conveying assembly. The step of lowering the conveying assembly may include lowering the conveying assembly that pivots about the rear connection component to at least one of place the conveying assembly at an angle with respect to the polishing pad or place the conveying assembly substantially parallel to the polishing pad.

The step of oscillating the conveying assembly may include moving the conveying assembly in a radial direction between a point near a center and a point near the edge of the polishing pad. The step of applying the downward force may include providing a pneumatic cylinder that applies the downward force.

In yet another aspect, the present invention provides a conditioning sub-assembly for conditioning a polishing pad. The conditioning sub-assembly includes a conveying mechanism for conveying a conditioning surface to a polishing pad during conditioning such that after conditioning concludes another conditioning surface is advanced for conditioning the polishing pad and an arm connected to said conveying assembly.

The conditioning sub-assembly may further include a conditioning tape that includes said conditioning surface. The conditioning sub-assembly may further still include a supply reel adapted to hold a supply roll of said conditioning surface and a take-up reel to collect conditioning surface that is used for conditioning a polishing pad.

DETAILED DESCRIPTION OF THE PREFERRED EMBODIMENTS

The present invention provides pad conditioning sub-assemblies including conveying assemblies that employ either continuous feed or closed loop abrasive tapes for effective pad conditioning. In the following description, numerous specific details are set forth in order to fully illustrate a preferred embodiment of the present invention. It will be apparent, however, that the present invention may be practiced without limitation to some specific details presented herein.

According to one embodiment of a conditioning sub-assembly of the present invention, a pivoting connection connects a conveying assembly to a pivoting arm. The conveying assembly is designed to convey a continuous feed abrasive tape or alternatively an abrasive tape in closed loop form such that another area of abrasive tape is advanced after the conclusion of a conditioning step. The pivoting connection allows the conditioning sub-assembly to acquire at least two different positions. In one position, the conveying body is positioned at an angle with respect to the polishing pad and in a second position the conveying body is positioned substantially parallel to the polishing pad.

Figure 1:
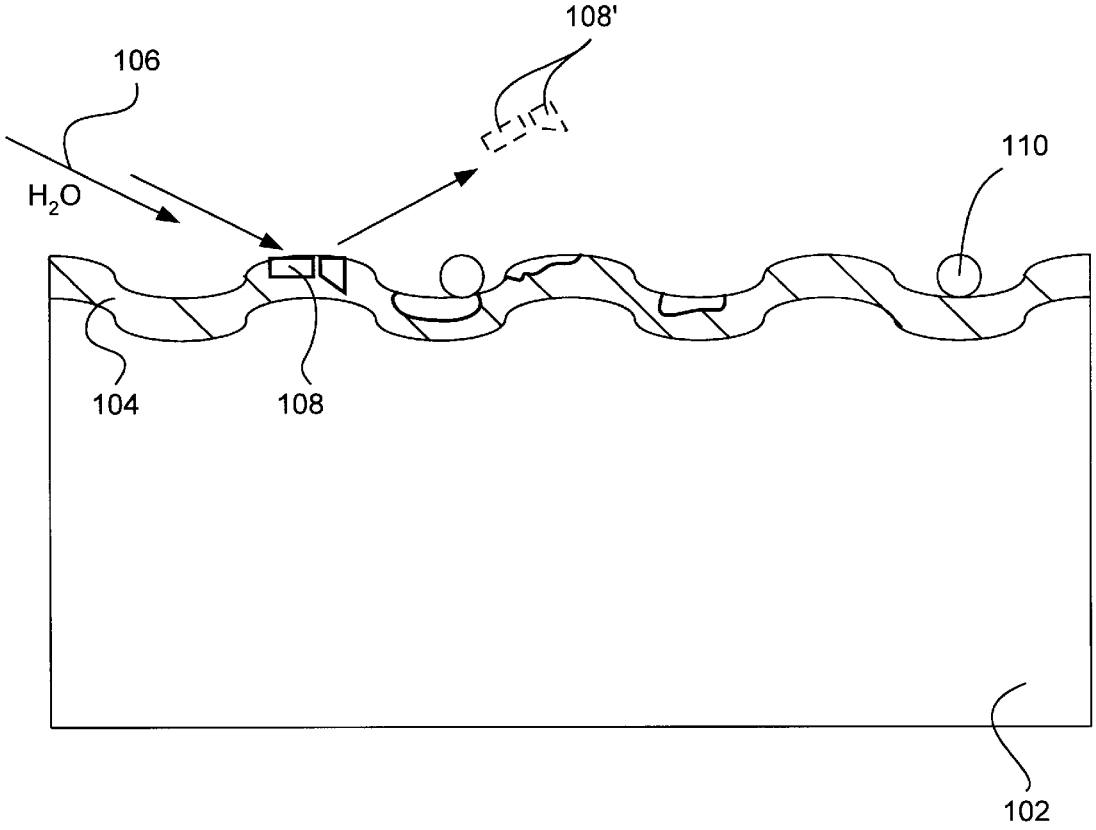
FIG. 1 shows a side-sectional view of a polishing pad undergoing conditioning according to conventional pad conditioning methods.
Figure 2:
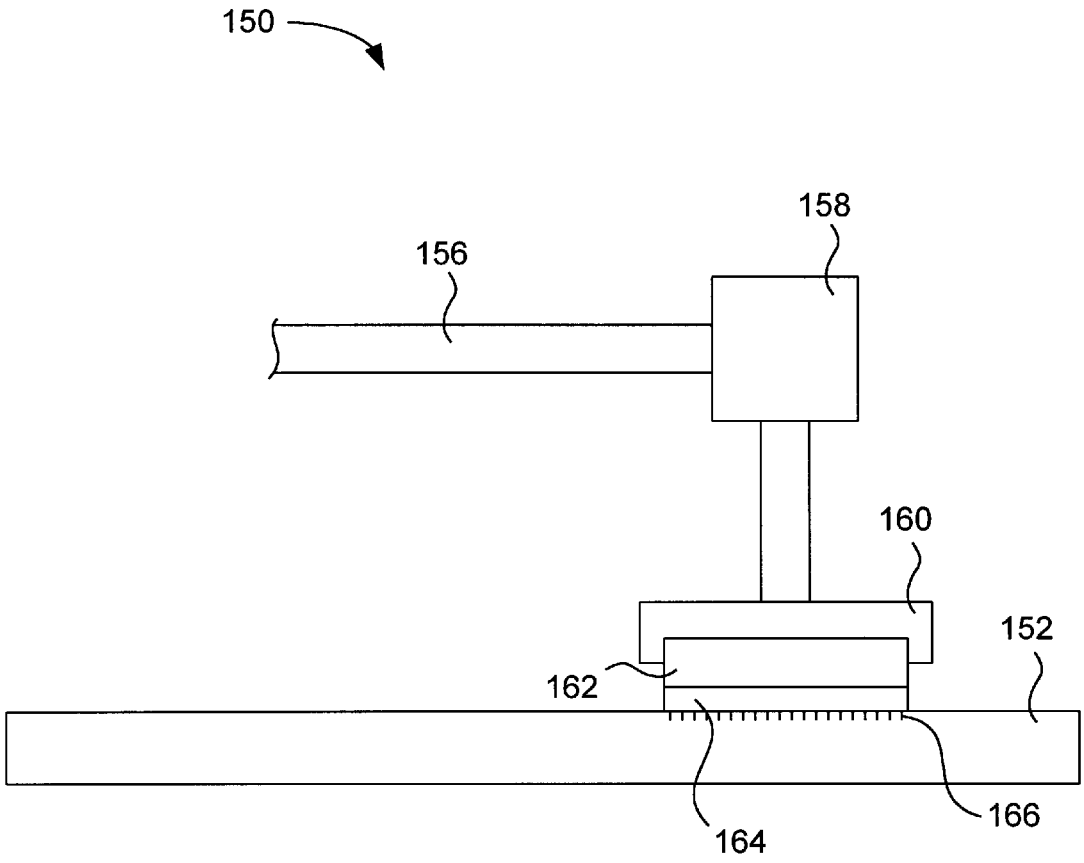
FIG. 2 shows a side-sectional view of a conditioning sub-assembly integrated into conventional CMP systems to carry out the pad conditioning process shown in FIG. 1.
Figure 3A:
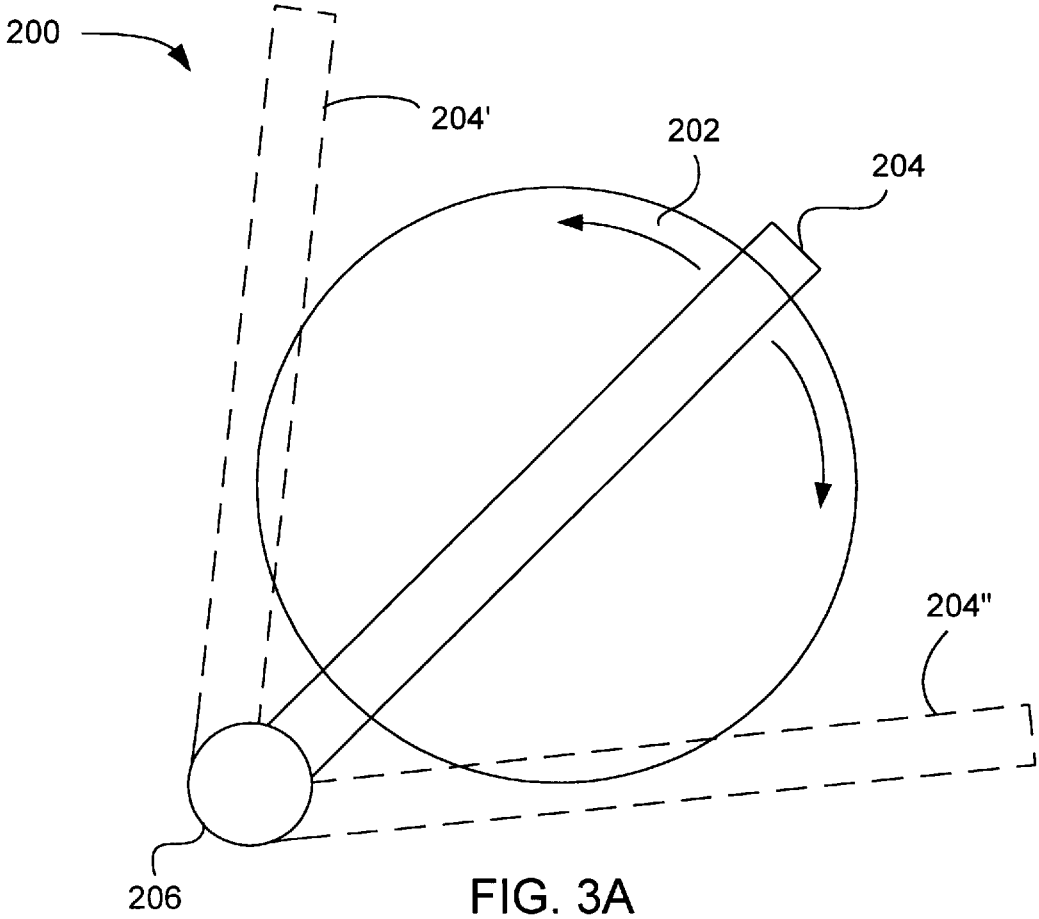
FIG. 3A shows a top view of a conditioning sub-assembly integrated into modem CMP systems to carry out the pad conditioning process shown in FIG. 1.
Figure 3B:
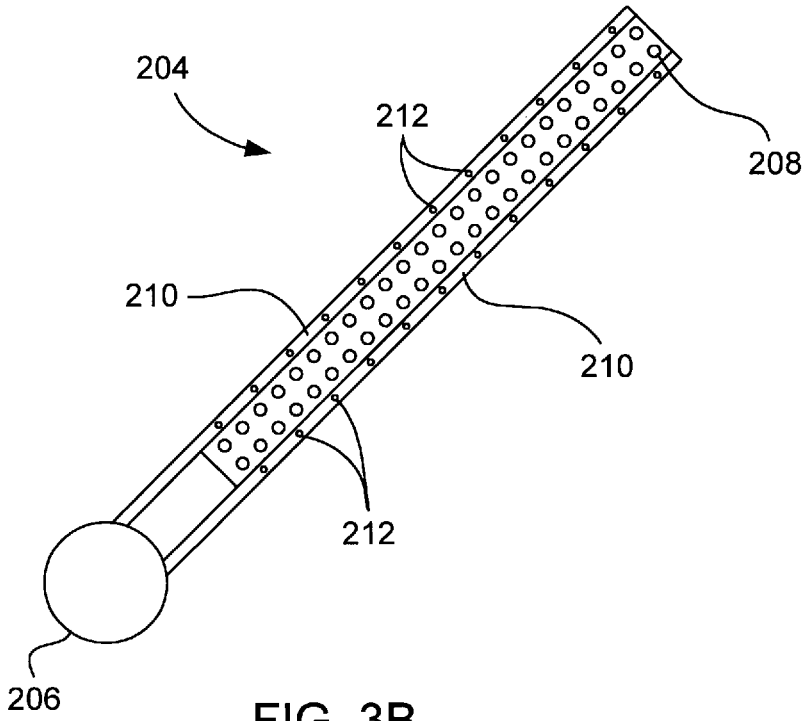
FIG. 3B shows a bottom view of the conditioning arm of the conditioning sub-assembly of FIG. 3A.
Figure 4A:
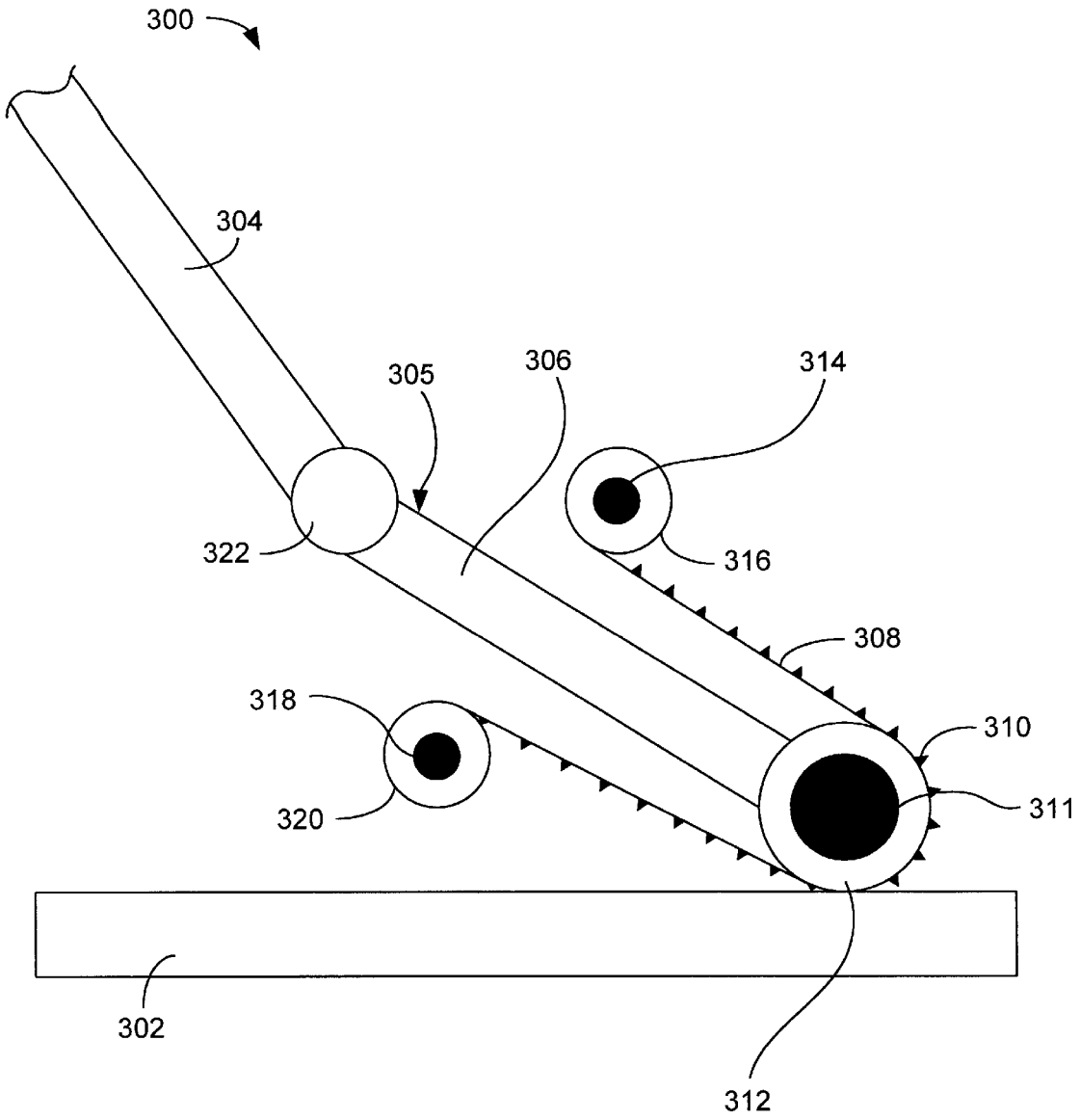
FIG. 4A shows a side-sectional view of a first position of a pad conditioning sub-assembly, according to one embodiment of the present invention, including a continuous feed abrasive tape.

FIG. 4A shows some significant components of a conditioning sub-assembly 300, according to one embodiment of the present invention. A pivoting connection 322 connects pivoting arm 304 and conveying assembly 305. FIG. 4A shows conditioning sub-assembly in a position where conveying assembly 305 is at an angle with respect to polishing pad 302. Conveying assembly 305 includes a first supporting arm 306 and a second supporting arm (not shown) connected to each other at a front end by a front bridging component 312. A pin connection 311 secures first supporting arm 306 to the front bridging component on one side and on another side another pin connection (not shown) secures second supporting arm to the front bridging component. Pivoting connection 322, similarly connects first and second supporting arms at a rear end of the conveying assembly 305 and serves as a rear bridging or connection component. As shown in FIG. 4A, the front end of conveying assembly 305 is closer to polishing pad 302 than the rear end during pad conditioning.

Conveying assembly 305 is designed to convey a continuous feed abrasive tape 308 having abrasives 310 to a surface of polishing pad 302 during pad conditioning. A supply roll 314 of continuous feed abrasive tape 308 is loaded on a supply reel 316 and is fed at a top portion of conveying assembly 305, from where it passes over and reels around underneath front bridging component 312. A used portion of abrasive tape 308 is collected in a take-up reel 320 as take-up roll 318.

In one embodiment, front bridging component 312 may be a tension roller as it holds abrasive tape 308 under tension. Furthermore, the tension roller may be coupled to a motor, which may be turned on to drive abrasive tape 308 from supply reel 316 to take-up reel 320. Alternatively, supply reel 316 may be coupled to such a motor to similarly drive abrasive tape 308. It is, however, preferable to have take-up reel 320 coupled to a motor to maintain abrasive tape 308 under sufficient tension as the tape is being collected by take-up reel 320.

According to one embodiment, pivoting connection 322 may be a pivoting roller, about which at least conveying assembly 305 can pivot with respect to pivoting arm. Those skilled in the art will, however, recognize that it is preferable to have provisions for both pivoting arm 304 and conveying assembly 306 to pivot about pivoting connection 322.

Abrasive or conditioning tape 308 may include a tape having abrasive particles well known to those skilled in the art, e.g. diamond and silicon carbide particles, secured thereon. In a preferred embodiment, however, abrasive tape 308 may be made by bonding abrasive particles 310 to a tape. The surface of abrasive tape 308 may be similar to the surface of an abrasive tape commercially available from Marshall Laboratories (previously 3M Corporation) of Marshall, Minn.

Figure 4B:
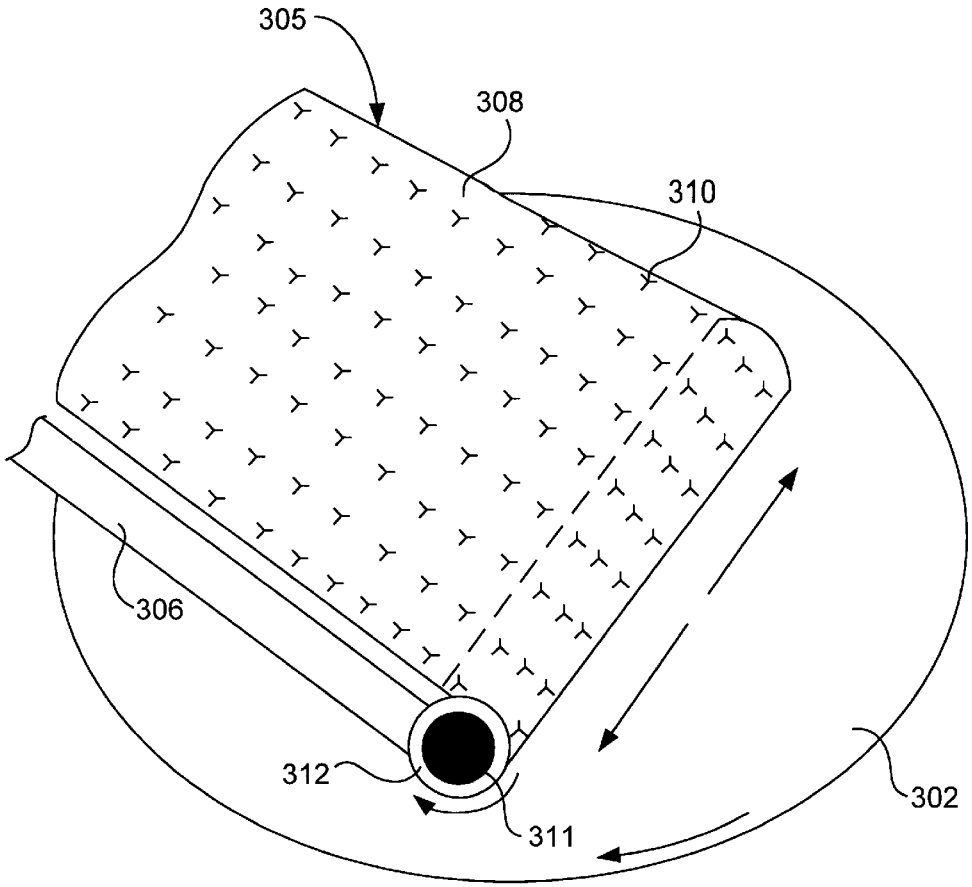
FIG. 4B shows a top perspective view of the continuous feed abrasive tape mounted on the conveying assembly of the pad conditioning sub-assembly shown in FIG. 4A.

FIG. 4B shows a top perspective view of a portion of conveying assembly 305 in the position shown in FIG. 4A effectively conditioning the surface of polishing pad 302. FIG. 4B shows that abrasive tape 308 is driven in a direction such that abrasive particles 310 are not pulled out by the action of the rotating or orbiting polishing pad. FIG. 4B also shows that during pad conditioning, conveying body 305 oscillates in a radial direction, e.g., by connecting the pivoting arm to a motor, on polishing pad 302.

Figure 4C:
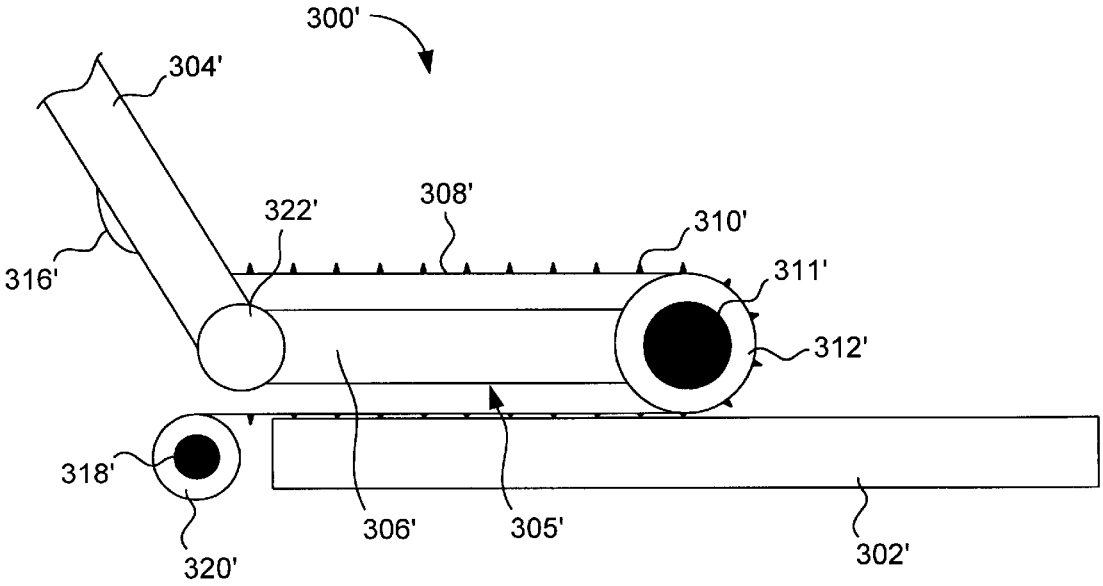
FIG. 4C shows a side-sectional view of a second position of the pad conditioning sub-assembly, according to one embodiment of the present invention, including a continuous feed abrasive tape.

FIG. 4C shows a conditioning sub-assembly 300', which is substantially similar to conditioning sub-assembly 300 of FIG. 4A, but pivoting arm 304' and a conveying body 305' pivot about a pivoting connection 322' such that conveying body 305' is substantially parallel to polishing pad 302. The features of conditioning sub-assembly 300' such as first support arm 306', supply reel 316', take-up reel 320', take-up roll 318', front bridge component 312', pin connection 311', abrasive tape 308' and abrasive particles 310' are substantially similar to their counterparts in FIG. 4A. During pad conditioning, conditioning sub-assembly 300' oscillates on polishing pad 302 like conditioning sub-assembly 300 shown in FIG. 4B.

It is important to note that in conveying assembly 305' of FIG. 4C, a relatively greater amount of abrasive tape 308' contacts polishing pad 302 than abrasive tape 308 of conveying assembly 305 shown in FIG. 4A. In the position of conveying assembly 305, as shown in FIG. 4A, at least a portion of the abrasive tape underneath the front bridging component engages the polishing pad as opposed to conveying assembly 305', as shown in FIG. 4C, that is positioned so that at least a portion of the abrasive tape underneath the conveying body engages the polishing pad. Although conditioning sub-assemblies 300 and 300' may be employed in modern and conventional CMP systems, it is preferable to employ conditioning sub-assembly 300 in conventional CMP systems and conditioning sub-assembly 300' in modern CMP systems.

Those skilled in the art will recognize that it is not necessary to employ two supporting arms, as mentioned above in reference to FIGS. 4A, 4B and 4C, and that one supporting arm may work well. If a single arm is employed, the front bridging component may function as a guiding component, which is adapted to guide the conditioning surface about the conveying assembly, thereby allowing another area of the conditioning surface to advance and become available for conditioning.

Figure 5:
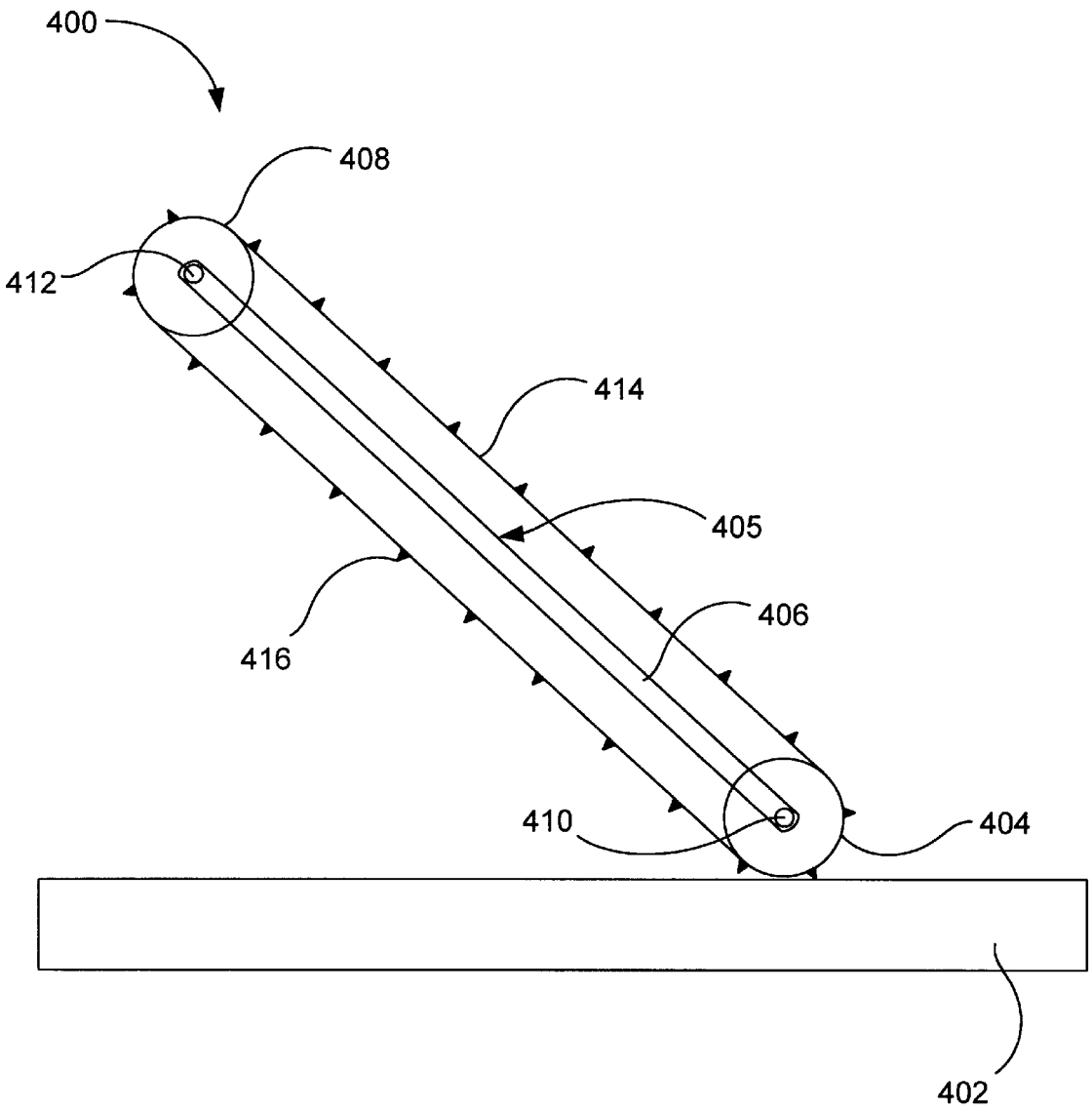
FIG. 5 shows a side sectional view of a conveying assembly, according to an alternative embodiment of the present invention, including a closed loop abrasive tape.

FIG. 5 shows a conveying assembly 400, according to an alternative embodiment of the present invention, designed to convey conveying a closed loop of conditioning or abrasive tape 414 to a polishing pad 402 during pad conditioning. Conveying assembly 400 may connect to a pivoting arm (not shown to simplify illustration) at a rear bridging component 408 and may be capable of acquiring the positions shown in FIGS. 4A and 4C. A pin connection 412 facilitates securing rear bridging component 408, e.g., a roller, to a first supporting arm 406. Another pin connection (not shown) similarly secures rear bridging component 408 to a second supporting arm (not shown). At a front end of conveying assembly 400, a front bridging component 404, e.g., a tension roller, connects to a first arm 406 by a pin connection 410 and similarly to a second arm (not shown) by another pin connection (not shown).

Abrasive tape 414 having abrasive particles 416 is disposed above and reels around underneath both the first and second bridging components 408 and 404 to form a closed loop abrasive tape. A motor that drives abrasive tape 414 may be coupled to front bridging component 404, rear bridging component 408 or both.

A typical pad conditioning process, according to one embodiment of the present invention, begins by providing the conditioning sub-assemblies of the present invention that employ conveying assemblies described above. A conditioning reagent may then be introduced on the polishing pad by methods well known to those skilled in the art.

Next, a conditioning tape is mounted on the conveying assembly employed as described in reference to FIGS. 4A and 5. By way of example, when the conditioning sub-assembly of FIG. 4A is employed to carry out pad conditioning, a supply reel holding a supply roll of abrasive tape for feeding into the conveying assembly and a take-up reel designed to collect the abrasive tape after it has been used is provided. The abrasive tape is then fed at a top portion of the conditioning assembly such that the conditioning tape is disposed above and reels around underneath the front bridging component. As another example, when the closed loop configuration of the abrasive tape as shown in FIG. 5 is employed, the abrasive tape is mounted such that at the front end of the conveying assembly, the abrasive tape is disposed above and reels around underneath the front bridging component and at the rear end of the conveying assembly, the abrasive tape is disposed above and reels around underneath the rear bridging component to form a closed loop abrasive tape around the conveying assembly.

The conveying assembly is then lowered to contact the polishing pad and pad conditioning commences when the conveying assembly oscillates in a radial direction on the polishing pad, e.g., by activating a motor. By way of example, in one embodiment of the present invention, the conveying assembly is lowered as shown in FIG. 4A, i.e. at least a portion of the abrasive tape positioned underneath the front bridging component contacts and engages the polishing pad. Alternatively, in another embodiment of the present invention, the conveying assembly is lowered as shown in FIG. 4C, i.e. at least a portion of the abrasive tape positioned underneath the conveying assembly contacts and engages the polishing pad. The oscillating motion of the conveying body is accompanied by a down force applied by a pneumatic cylinder that facilitates the abrasive particles on the abrasive tape to engage the polishing pad.

After pad conditioning according to the present invention has concluded, a new or different area of the abrasive tape is exposed to the polishing pad. By way of example, if the conditioning sub-assemblies shown in FIGS. 4A and 4C are employed, a predetermined length of conditioning tape is advanced to the conveying assembly so that a fresh or unused portion of the conditioning tape is in position to carry out pad conditioning and the used portion of the abrasive tape is taken up by the take-up reel. As another example, if the conditioning sub-assembly shown in FIG. 5 is employed, a predetermined length of the abrasive tape mounted on the conveying assembly is advanced so that a different area of the abrasive tape is in position to carry out conditioning.

The conditioning sub-assemblies of the present invention represent a marked improvement over the conditioning sub-assemblies currently employed. The conditioning sub-assemblies of the present invention significantly reduce the likelihood of wafer surface scratching due to a dislodged abrasive particle. In the continuous feed abrasive tape embodiment, for example, an area of the abrasive tape contacts the polishing pad typically for a few seconds during pad conditioning and after pad conditioning has concluded this area of the abrasive tape is taken up and a new length of the abrasive tape is advanced for the next pad conditioning step. Consequently, there is an absence of repeated conditioning by a same area of the abrasive tape and the likelihood that an abrasive particle is dislodged is significantly reduced.

As a further example, in the closed loop abrasive tape embodiment, after the conclusion of each pad conditioning step, a different area of the abrasive tape is advanced to contact the polishing pad. As a result, repeated conditioning of the polishing pad by the same abrasive tape area is prevented and the likelihood of dislodging an abrasive particle is reduced.

The conditioning sub-assemblies of the present invention also eliminate the high cost associated with replacing conditioning disks, which are currently employed in the conditioning sub-assemblies of conventional CMP systems. According to the present invention, a new or different area of the abrasive tape is advanced to the conveying assembly after a pad conditioning step concludes. Therefore, the need for replacing the entire conditioning disk due to a worn-out abrasive surface is totally eliminated. With regards to the closed loop abrasive tape embodiment, a new abrasive tape is mounted on the conveying assembly when the old abrasive tape is worn out due to repeated use.

Those skilled in the art will recognize that mounting abrasive tapes on the conveying assemblies of the present invention also eliminates the above described drawback of the abrasive tape peeling off the conditioning arm suffered by the modem CMP systems.

In the continuous feed abrasive tape embodiment, the changes on the wafer surface need not be closely monitored because a new area of abrasive tape is advanced after every pad conditioning step. Furthermore, a "wear-in" process designed to remove all loosely held abrasive particle from the abrasive tape is also eliminated. This translates into a higher throughput for the wafer CMP process.

Although the foregoing invention has been described in some detail for purposes of clarity of understanding, it will be apparent that certain changes and modifications may be practiced within the scope of the appended claims. For example, while the specification has described the pad conditioning sub-assemblies of the present invention to be used in the context of wafer CMP, there is no reason why in principle such pad conditioning sub-assemblies could not be used to condition a polishing pad used in other polishing applications, e.g., polishing optical substrates, magnetic media substrates, etc. Therefore, the present embodiments are to be considered as illustrative and not restrictive, and the invention is not to be limited to the details given herein, but may be modified within the scope of the appended claims.

What is claimed is:

1. A conditioning sub-assembly comprising:

a conveying assembly for conveying a conditioning surface to a polishing pad during conditioning comprising: an arm; and a guiding component connected to said arm and adapted to guide said conditioning surface about said conveying assembly, thereby allowing another area of the conditioning surface to advance and become available for conditioning;

a rear connection component connected to said arm at a rear end of said conveying assembly; and a pivoting arm connected to said rear connection component that functions as a pivoting connection about which the pivoting arm and the conveying assembly can pivot.

2. The conditioning sub-assembly of claim 1, further comprising:

a conditioning tape that includes said conditioning surface;

a supply reel for supplying said conditioning tape on said conveying assembly; and a take-up reel adapted to collect said conditioning tape off said conveying assembly.

3. The conditioning sub-assembly of claim 2, wherein said conditioning surface has abrasive particles disposed thereon.

4. The conditioning sub-assembly of claim 2, wherein said guiding component includes a tension roller designed to maintain said conditioning tape under sufficient tension for effective conditioning of said polishing pad.

5. The conditioning sub-assembly of claim 4, wherein pin connections in the tension roller facilitate connection between said arm and the tension roller.

6. The conditioning sub-assembly of claim 1, wherein said arm is a first arm, said rear connection component is a first rear connection component, said pivoting arm is a first pivoting arm and further comprising:

a second arm separated from said first arm;

a front bridging component connecting said first arm and said second arm at a front end of said conveying assembly;

a rear bridging component connecting said first arm and said second arm at a rear end of said conveying assembly;

a second rear connection component connected to said second arm at a rear end of said conveying assembly; and a second pivoting arm connected to a said second rear connection component that functions as a pivoting connection about which the second pivoting arm and the conveying assembly can pivot; and a conditioning tape including a conditioning surface;

wherein said conveying assembly is adapted to receive said conditioning tape such that during conditioning said conditioning tape is disposed above and reels around underneath said front bridging component.

7. The conditioning sub-assembly of claim 1, wherein the pivoting arm in a first position places said conveying assembly at an angle with respect to the polishing pad and allows at least a portion of the conditioning tape underneath said guiding component to contact the polishing pad during conditioning of the polishing pad.

8. The conditioning sub-assembly of claim 1, wherein the pivoting arm in a second position places the conveying assembly almost parallel to the polishing pad and allows at least a portion of the conditioning tape underneath said conveying assembly to contact the polishing pad during conditioning of the polishing pad.

9. The conditioning sub-assembly of claim 1, wherein said pivoting arm is connected to a pneumatic cylinder that applies a downward force during conditioning of the polishing pad.

10. The conditioning sub-assembly of claim 1, wherein said pivoting arm is in communication with an actuator that allows the conditioning sub-assembly to oscillate in a radial direction on the polishing pad during conditioning of the polishing pad.

11. The conditioning sub-assembly of claim 1, further comprising:

a conditioning tape including said conditioning surface;

wherein said conditioning tape is disposed above and reels around underneath said rear connection component to form a closed loop of conditioning tape around the conveying assembly.

12. The conveying assembly of claim 11, wherein the rear connection component includes a roller.

13. The conditioning sub-assembly of claim 11, wherein the pivoting arm in a first position places said conveying assembly at an angle with respect to the polishing pad and allows at least a portion of the conditioning tape underneath said guiding component to contact the polishing pad during conditioning of the polishing pad.

14. The conditioning sub-assembly of claim 11, wherein the pivoting arm in a second position places the conveying assembly almost parallel to the polishing pad and allows at least a portion of the conditioning tape underneath said conveying assembly to contact the polishing pad during conditioning of the polishing pad.

15. A process for conditioning a polishing pad comprising:

providing a conditioning sub-assembly including a conveying assembly for conveying a conditioning surface to a polishing pad during conditioning comprising:

an arm; and a guiding component connected to said arm and adapted to guide said conditioning surface about said conveying assembly, thereby allowing another area of the conditioning surface to advance and become available for conditioning;

contacting said conditioning surface of said conveying assembly with said polishing pad; and oscillating said conveying assembly on said polishing pad.

16. The process of claim 15, wherein said contacting said conditioning surface includes placing said conveying assembly at an angle with respect to the polishing pad or substantially parallel to the polishing pad.

17. The process of claim 15, wherein oscillating said conveying assembly includes moving said conveying assembly in a radial direction between a point near a center and a point near the edge of the polishing pad.

18. The process of claim 15 further comprising introducing a conditioning reagent on said polishing pad.

19. The process of claim 15 further comprising mounting a conditioning tape including said conditioning surface on said conveying assembly.

20. The process of claim 19, wherein said mounting said conditioning tape includes:

providing a supply reel that holds a feed roll of conditioning tape and a take-up reel that collects the conditioning tape provided by said supply reel; and supplying the conditioning tape on said conveying assembly such that said conditioning tape is disposed above and reels around underneath said guiding component.

21. The process of claim 20, after said applying a downward force, further comprising feeding a predetermined amount of said conditioning tape on said conveying assembly; and conditioning said polishing pad by at least a portion of said predetermined amount of said conditioning tape.

22. The process of claim 19, wherein said mounting said conditioning tape includes supplying the conditioning tape on said conveying assembly such that said conditioning tape is disposed above and reels around underneath said guiding component and said conditioning tape is disposed above and reels around underneath said rear connection component to form a closed loop of conditioning tape around said conveying assembly.

23. The process of claim 15 further comprising applying a downward force on said conveying assembly.

24. The process of claim 23, wherein said applying the downward force includes providing a pneumatic cylinder that applies the downward force.

* * * * *